US008336131B2

(12) United States Patent
Ball et al.

(10) Patent No.: US 8,336,131 B2
(45) Date of Patent: Dec. 25, 2012

(54) CABLE ACTUATED DRAIN

(75) Inventors: William T. Ball, Colorado Springs, CO (US); Eric Pilarczyk, Colorado Springs, CO (US); Kevin Hogan, Prairie Village, KS (US); Carl Riesco, Independence, MO (US); William L. Carlson, Elbert, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 474 days.

(21) Appl. No.: 12/542,205

(22) Filed: Aug. 17, 2009

(65) Prior Publication Data

US 2010/0037392 A1 Feb. 18, 2010

Related U.S. Application Data

(60) Provisional application No. 61/089,692, filed on Aug. 18, 2008.

(51) Int. Cl.
*E03C 1/232* (2006.01)

(52) U.S. Cl. ..... 4/683

(58) Field of Classification Search ..... 4/680, 683, 4/681

See application file for complete search history.

(56) References Cited

U.S. PATENT DOCUMENTS

| | | | | |
|---|---|---|---|---|
| 2,059,120 | A | 10/1936 | Kreuzer et al. | |
| 4,085,469 | A | 4/1978 | Petursson | |
| 4,352,213 | A * | 10/1982 | Watts | 4/683 |
| 4,411,028 | A | 10/1983 | Hogner | |
| 4,594,738 | A | 6/1986 | Gebert | |
| 4,908,883 | A | 3/1990 | Rivera | |
| 4,910,807 | A * | 3/1990 | Willis | 4/683 |
| 5,394,572 | A * | 3/1995 | Humphreys | 4/683 |
| 5,745,931 | A | 5/1998 | Ball | |
| 5,758,368 | A | 6/1998 | Ball | |
| 5,890,241 | A | 4/1999 | Ball | |
| 6,066,119 | A | 5/2000 | Ball | |
| 6,138,298 | A | 10/2000 | Ball | |
| 6,148,454 | A | 11/2000 | Ball | |
| 6,154,898 | A | 12/2000 | Ball | |
| 6,173,459 | B1 | 1/2001 | Ball | |
| 6,226,806 | B1 | 5/2001 | Ball | |
| 6,317,906 | B1 | 11/2001 | Ball | |
| 6,418,570 | B1 | 7/2002 | Ball | |

(Continued)

FOREIGN PATENT DOCUMENTS

EP 0322367 6/1989

OTHER PUBLICATIONS

International Search Report for International (PCT) Application No. PCT/US2010/045795, mailed Oct. 6, 2010.

(Continued)

*Primary Examiner* — Lori Baker
(74) *Attorney, Agent, or Firm* — Sheridan Ross P.C.

(57) ABSTRACT

An improved drain actuates system that includes a cable to actuate a head or stopper of a drain. More specifically, one end of the cable is associated with the drain without additional moving parts and another end of the cable associated with an overflow cap of an overflow system wherein rotation of the overflow cap selectively moves the cable to move the head of the drain. The internal components associated with the overflow end of the cable that allow it to actuate the drain are fully accessible through the overflow port of the plumbing system.

14 Claims, 9 Drawing Sheets

U.S. PATENT DOCUMENTS

| | | | |
|---|---|---|---|
| 6,546,573 | B1 | 4/2003 | Ball |
| 6,631,623 | B1 | 10/2003 | Ball |
| 6,637,050 | B1 | 10/2003 | Ball |
| 6,640,358 | B2 | 11/2003 | Ball |
| 6,675,406 | B2 | 1/2004 | Ball |
| 6,675,407 | B1 | 1/2004 | Ball |
| 6,681,420 | B1 | 1/2004 | Ball |
| 6,691,411 | B2 | 2/2004 | Ball |
| 7,127,752 | B2 | 10/2006 | Ball |
| 7,451,502 | B2 | 11/2008 | Ball |
| 7,503,083 | B2 | 3/2009 | Ball |
| 8,201,289 | B2 | 6/2012 | Edmonds et al. |
| 8,234,726 | B2 | 8/2012 | Shafik |
| 2004/0068793 | A1 | 4/2004 | Ball |
| 2004/0103474 | A1 | 6/2004 | Ball |
| 2004/0111797 | A1 | 6/2004 | Ball |
| 2004/0117907 | A1 | 6/2004 | Ball |
| 2007/0039098 | A1 | 2/2007 | Ball |
| 2007/0130689 | A1 | 6/2007 | Condon et al. |
| 2008/0047060 | A1 | 2/2008 | Ball |
| 2008/0196161 | A1 | 8/2008 | Ball |
| 2008/0235866 | A1 | 10/2008 | Ball |
| 2011/0000014 | A1 | 1/2011 | Ball et al. |

OTHER PUBLICATIONS

Written Opinion for International (PCT) Application No. PCT/US2010/045795, mailed Oct. 6, 2010.

Filing of Prior Art Pursuant to Section 34.1 of the Patent Act for Canadian Patent Application No. 2675721 enclosing a product specification sheet dated Apr. 19, 1995 of Oakvill Stamping & Bending entitled "Bath Waste/Overflows." 8 pages.

Official Action for U.S. Appl. No. 12/830,131, mailed Jan. 27, 2012.

* cited by examiner

CABLE ACTUATED DRAIN

This application claims the benefit of U.S. Provisional Patent Application Ser. No. 61/089,692 filed Aug. 18, 2008, the entire disclosure which is incorporated by reference herein.

This application also is related to various applications and patents related to overflow systems associated with bathtubs or other basins. That is, this application is related to U.S. patent application Ser. No. 09/593,724 filed Jun. 13, 2000, U.S. Patent Application Publication Nos. 2004/0068793, filed Sep. 30, 2003, 2004/0117907, filed Dec. 10, 2003, 2004/0111797, filed Dec. 17, 2003, 2008/0235866, filed Mar. 28, 2008 and 2004/0103474 filed Nov. 25, 2003. In addition, this application is related to U.S. Pat. No. 6,691,411, filed Sep. 17, 2001, U.S. Pat. No. 6,675,406, filed Aug. 28, 2002, U.S. Pat. No. 6,637,050, filed Aug. 16, 2002, U.S. Pat. No. 7,127,752, filed Dec. 17, 2003 and U.S. Pat. No. 5,890,241, filed Feb. 4, 1998. The entire disclosures of which are incorporated by reference herein.

This application is also related to various patents and patent publications related to drain systems for tubs and other basins. More specifically, U.S. Patent Application Publication Nos. 2007/0039098, filed Aug. 19, 2005 and 2008/0047060, filed Aug. 22, 2006. Furthermore, U.S. Pat. No. 5,745,931, filed Feb. 9, 1996, U.S. Pat. No. 5,758,368 filed May 21, 1997, U.S. Pat. No. 6,148,454, filed Mar. 4, 1999, U.S. Pat. No. 6,154,898, filed May 19, 1999, U.S. Pat. No. 6,317,906, filed Mar. 10, 1998, U.S. Pat. No. 6,173,459, filed May 26, 1999, U.S. Pat. No. 6,226,806, filed Aug. 2, 2000, U.S. Pat. No. 6,640,358, filed Feb. 6, 2001, U.S. Pat. No. 6,418,570, filed Apr. 4, 2001, U.S. Pat. No. 6,546,573, filed Jul. 17, 2002, U.S. Pat. No. 6,681,420, filed Dec. 3, 2002, U.S. Pat. No. 6,675,407, filed Nov. 8, 2002, U.S. Pat. No. 7,451,502, filed Aug. 23, 2005 and U.S. Pat. No. 7,503,083, filed Aug. 23, 2005, are also related to the inventions described herein. The entire disclosures of each of the prior art references listed above are incorporated by reference herein.

This application is also related to U.S. Patent Application Publication No. 2008/0196161, filed Apr. 10, 2008, which is related to a flexible waste water pipe, the entire disclosure of which is incorporated by reference herein.

FIELD OF THE INVENTION

Embodiments of the present invention are generally related to devices for facilitating the opening and closing of a stopper or other closure device associated with a drain of a bathtub or other fluid-holding basin. One embodiment of the present invention, specifically, employs a sheathed cable that is associated with a portion of the overflow assembly of a bathtub that actuates a stopper by adjusting a cap of the overflow assembly.

BACKGROUND OF THE INVENTION

A number of cable and chain devices currently exist that allow for manipulation of drain position and in a bathtub, a washbasin, a hot tub, a baptismal, a Jacuzzi-type product, and other similar devices (hereinafter "tubs"). Drain manipulation and control devices that employ chains and cables suffer from problems posed by corrosion, chain tangling, and rigidity issues. These drawbacks of current devices are further compounded by the fact that they are generally inaccessible for repair. As these devices are typically located within the tub or surrounding structure, maintenance or repair thereof is complicated and costly. Typically, unless the original installer provided an access panel, costly removal, replacement, and repair of the stone, tile, or other material surrounding the drain is necessary.

More specifically, attention is directed to U.S. Pat. No. 4,594,738 to Gebert ("Gebert") and U.S. Pat. No. 2,059,120 to Kreuzer ("Kreuzer") that disclose devices that employ a cable to selectively open and close the stopper associated with a drain assembly of a bathtub. More specifically, Kreuzer discloses a handle that is rotatably interconnected by a crank arm to a cable that is positioned within an overflow drain pipe. The overflow drainpipe is also associated with a primary drain system of a bathtub. The cable is also connected to a stud that is associated with a lever that actuates the closure mechanism of the drain. Upon rotation of the handle, the crank arm repositions one end of the cable, thereby rotating the lever to move the stopper out of a strainer body associated with a drain to allow fluid to flow into the primary drain pipe. One drawback of Kreuzer is that the cable is located on the inside of the drain pipe. The problem with this configuration is that the cable cannot be easily adjusted to accommodate overflow assemblies of various lengths. More specifically, manufacturers provide bathtubs of various dimensions. Providing a fixed length of cable as taught by Kreuzer does not allow length adjustment and, thus, may require modification by the installer. The adjustment generally required is in the range of about 6-8 inches but can be much greater. Yet another problem with Kreuzer is that turning of the handle is not efficiently transferred into movement that is needed to turn the lever. This deficiency is related to the fact that nothing is constraining or guiding the movement of the cable. Embodiments of the present invention, which will be described below, include a cable with a constrained cable that is positioned between an overflow elbow and a drain elbow, which eliminates "slop" and provides sufficient force to open the drain stopper.

Similarly, Gebert discloses a system that includes a rotatable linkage associated with the overflow components of a bathtub that is also associated with a bower cable situated on the outside of the overflow drain pipe. Rotation of the linkage moves the cable within its sheath to selectively move closure components associated with the drain portion that move the stopper into and out of the strainer body of the bathtub. One drawback of Gebert is that it includes a bellows portion that does not meet building code requirements. In addition, Gebert mentions the prevention of cable twisting caused by a lever associated with the drain. It is thus undesirable to use such levers and complicated devices to actuate a drain by way of the cable.

These examples of the prior art illustrate some of the deficiencies thereof. Namely, the drawbacks of the prior art include the need for complicated drain actuating mechanisms and they suffer from the inability to access all of the internal components of the drain opening system. More specifically, building codes often dictate that such cables and associated components must be accessible by plumbers after the bathtub is installed in order for the plumbers to affect needed repairs. In order to meet this standard, plumbers often must install panels to provide the needed access to the drain portion and the overflow portion of the drain. As will be appreciated by one skilled in the art, the fabrication of these access panels is costly and complicated and may be unsightly.

Thus, it is a long felt need in the art to provide a system that allows for selectively opening and closing a drain stopper of a bathtub without requiring access panels. The following specification describes a system and method that provides a drain actuation mechanism that allows enhanced access to all of the components thereof to facilitate repair without requiring the need of an access panel.

SUMMARY OF THE INVENTION

It is one aspect of the present invention to provide a drain system for use in a bathtub, a hot tub, a baptismal or a Jacuzzi (hereinafter "a bathtub"). Drain systems have two main branches, a primary drain system and an overflow system that are interconnected into a wastewater line. With reference to FIG. 1, bathtubs commonly employ an overflow port and a drain port. The overflow port is often associated with an overflow cap that hides an overflow pipe associated with the overflow port. The drain port is associated with a strainer body that interconnects to a drain pipe to the bottom portion of the bathtub. In operation, the drain is closed and the bathtub is fitted with water. The drain is usually manually blocked by a plug that maintains fluid in the bathtub. If the water level reaches the overflow port, some excess water will flow therethrough. These systems are well known and described in detail in the applications and patents referred to above.

It is thus one aspect of the present invention to provide an overflow port having a rotatable cover or other mechanism that is associated with a cable that is also associated with the drain. More specifically, one embodiment employs an overflow cap that is rotated to selectively close or open the drain. Such a system is aesthetically pleasing as the components associated with drain operations are hidden from view and are thus different from drain systems of the prior art that employ a stopper with a chain, a knob or other flip type switch that is used to open or close the drain. The contemplated system is also desirable since it alleviates the need for one to place his or her hands within often dirty waste water to remove the plug, for example, to open the drain. This aspect of the present invention will be appreciated by those in the medical field, for example, where basins or sinks may additionally include dangerous materials.

It is another aspect of the present invention to provide a drain system that does not require an access panel to reach the cable and associated components. It will be appreciated that such a system will reduce costs and complexity associated with a bathtub installation. That is, the need to accommodate the access panel or to repair stone, tile, or other similar materials associated with a bathtub are alleviated. The cable and associated components of one embodiment of the present invention may be repaired entirely from inside the bathtub by way of the overflow port. More specifically, to facilitate repairs the cover of the overflow system and/or drain is removed to reveal the inner workings of the drain actuating system, which can then be easily replaced.

It is another aspect of the present invention to provide a system that can be pressure tested. As disclosed in various patents and issued publications listed above related to overflow assemblies, embodiments of the present invention include a mechanism to selectively obstruct flow of water through the overflow system. That is, it is often required or desirable to test a plumbing system by blocking overflow ports, drains and inlets to the basin by filling the plumbing system of a house with water or air to assess leakage of any of the components. In order to facilitate these tests, the overflow port, for example, is often plugged with a balloon or a cap. One embodiment of the present invention, however, includes a diaphragm that is associated with the overflow port. After all testing is completed, the thin diaphragm is removed and discarded. This type of diaphragm helps address complexities of pressure testing a plumbing system and thus reduces costs.

It is another aspect of the present invention to provide a drain actuation mechanism that does not use and is devoid of complicated linkages mentioned in the prior art, for example. More specifically, embodiments of the present invention employ a cable that is associated on one end to the cap of an overflow drain and associated on a second end with a drain stopper. Thus, this embodiment of the present invention alleviates all linkages, levers, or the like associated with the drain portion of the plumbing system. In this configuration, the cable is also not necessarily held in place with respect to rotation and is free to twist, a feature not found in the systems of the prior art. One skilled in the art will appreciate that the cable could also be moved by flip levers, push-pull devices, etc., without departing from the scope of the invention.

It is another aspect of the present invention to employ a cable that is made of plastic instead of a braided or solid metal cables. Preferably, such cables are lighter, more flexible and corrosion resistant than metal cables.

It is yet another aspect of the present invention to provide an overflow cap having a handle or knob associated therewith that facilitates rotation thereof. Such a device would be ideal to be used by individuals of limited dexterity, such as the elderly or handicapped.

Thus, it is one aspect of the present invention to provide a system for controlling a drain valve that comprises an overflow conduit with a plate having an aperture therethrough. In one embodiment, a shaft is also included that is rotatably positioned within the aperture, the shaft further having an associated linkage. Such embodiment may also include a sheath that is associated with the overflow conduit and a drain conduit that received the cable. The cable has a first end and a second end wherein the first end is interconnected to the linkage such that rotation of the shaft moves the linkage and thus the first end of the cable from a first position to a second position along a generally arcuate path. One of skill in the art will appreciate that the cable may be associated with the shaft in other ways wherein the first end of the cable does not move along an arcuate path. The movement of the cable opens and closes a drain valve associated with the drain conduit. A cap may also be included that is rotatably associated with the overflow port and associated with said shaft such that rotation thereof moves the cable.

It is yet another aspect of the present invention to provide a system of controlling a drain valve that is associated with an overflow conduit and a drain conduit. In certain embodiments a sheath is associated with the overflow conduit and the drain conduit that houses a cable. The cable has a first end associated with the overflow conduit and a second end associated with the drain conduit. In this embodiment, the first end is accessible by way of an opening in said overflow conduit and the second end is accessible by way of an opening in the drain conduit.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
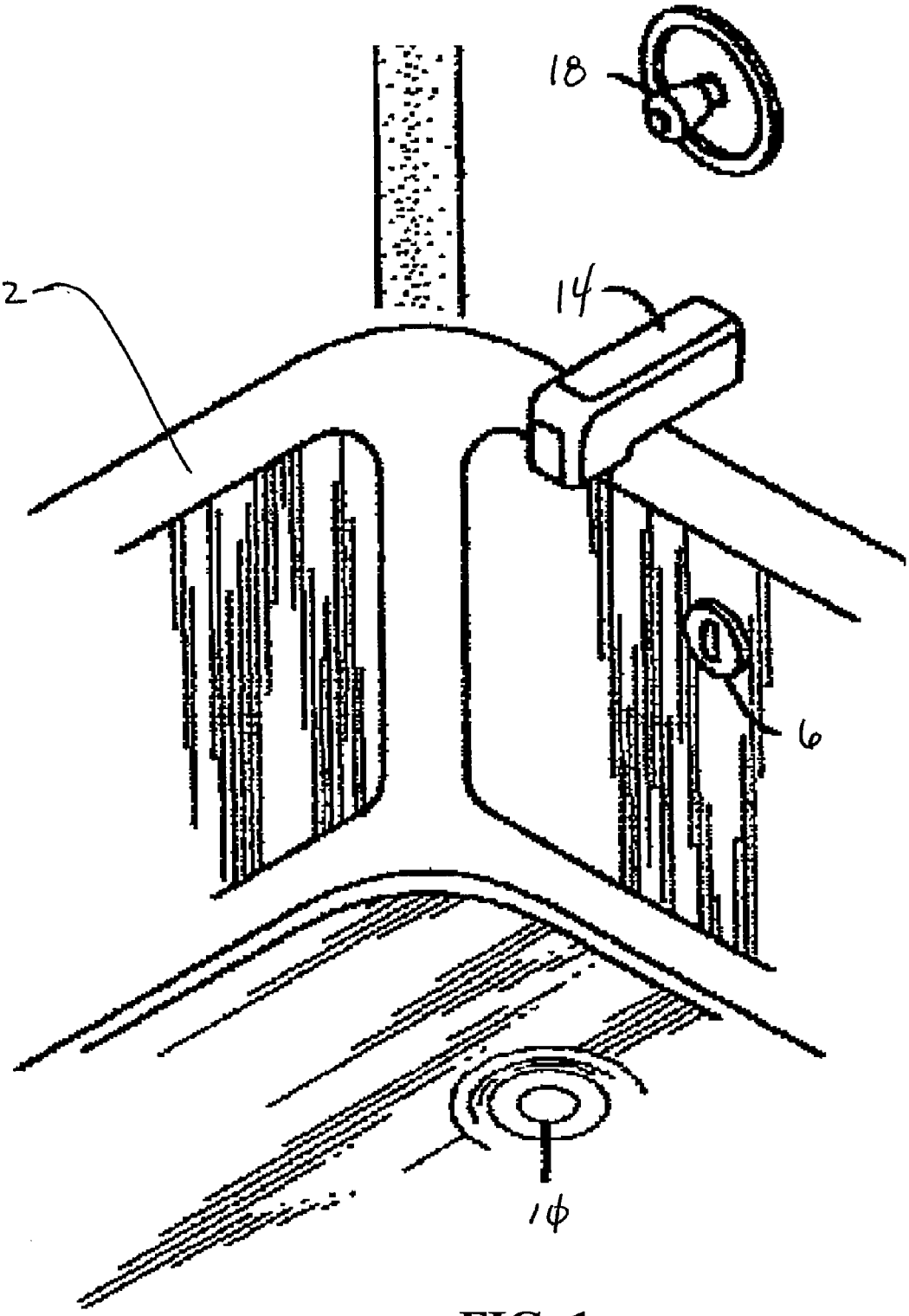
FIG. 1 is a partial perspective view of a bathtub assembly showing the overflow port and a drain port.

To assist in the understanding of the present invention the following list of components and associated numbering found in the drawings is provided herein:

| # | Components |
|---|---|
| 2 | Bathtub |
| 6 | Overflow port |
| 10 | Drain port |
| 14 | Water inlet |
| 18 | Knob |
| 20 | Overflow assembly |
| 22 | Overflow pipe |
| 24 | Drain assembly |
| 26 | Drain pipe |
| 30 | Overflow cap |
| 34 | Cable |
| 38 | Sheath |
| 42 | Post |
| 46 | Head |
| 50 | Overflow elbow |
| 54 | Overflow flange |
| 58 | Knob |
| 62 | Boss |
| 66 | Drain elbow |
| 70 | Drain flange |
| 74 | Seal |
| 78 | Strainer |
| 82 | Strainer flange |
| 86 | Boss |
| 90 | Threaded member |
| 94 | Seal |
| 98 | Nut |
| 102 | Plate |
| 106 | Shaft |
| 110 | Tapped hole |
| 114 | Screw |
| 118 | Fitting |
| 120 | Hub |
| 122 | Linkage |
| 124 | Tapped hole |
| 126 | Diaphragm |
| 130 | Shaft |
| 134 | Bolt |
| 134 | Sidewall |
| 138 | Seal |
| 142 | Hub |
| 146 | Spring |
| 150 | Solenoid motor |
| 154 | Magnet |

-continued

| # | Components |
|---|---|
| 158 | Primary drain |
| 162 | Tee |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIG. 1 shows a bathtub 2 having an overflow port 6 and a drain port 10. The bathtub 2 is filled with water by way of a water inlet 14 where a knob 18 is rotated.

Referring now to FIGS. 2-7, one embodiment of the present invention is shown that employs an overflow assembly 20 with an overflow pipe 22 and a drain assembly 24 with a drain pipe 26. The overflow pipe 22 includes a rotatable overflow cap 30 that is associated with a cable 34 situated in a sheath 38. The cable 34 is also associated with a post 42 of the drain assembly 24 wherein selective rotation of the cap 30 moves a head 46 of the drain assembly 24 from a first position of use to a second position of use.

Figure 2:
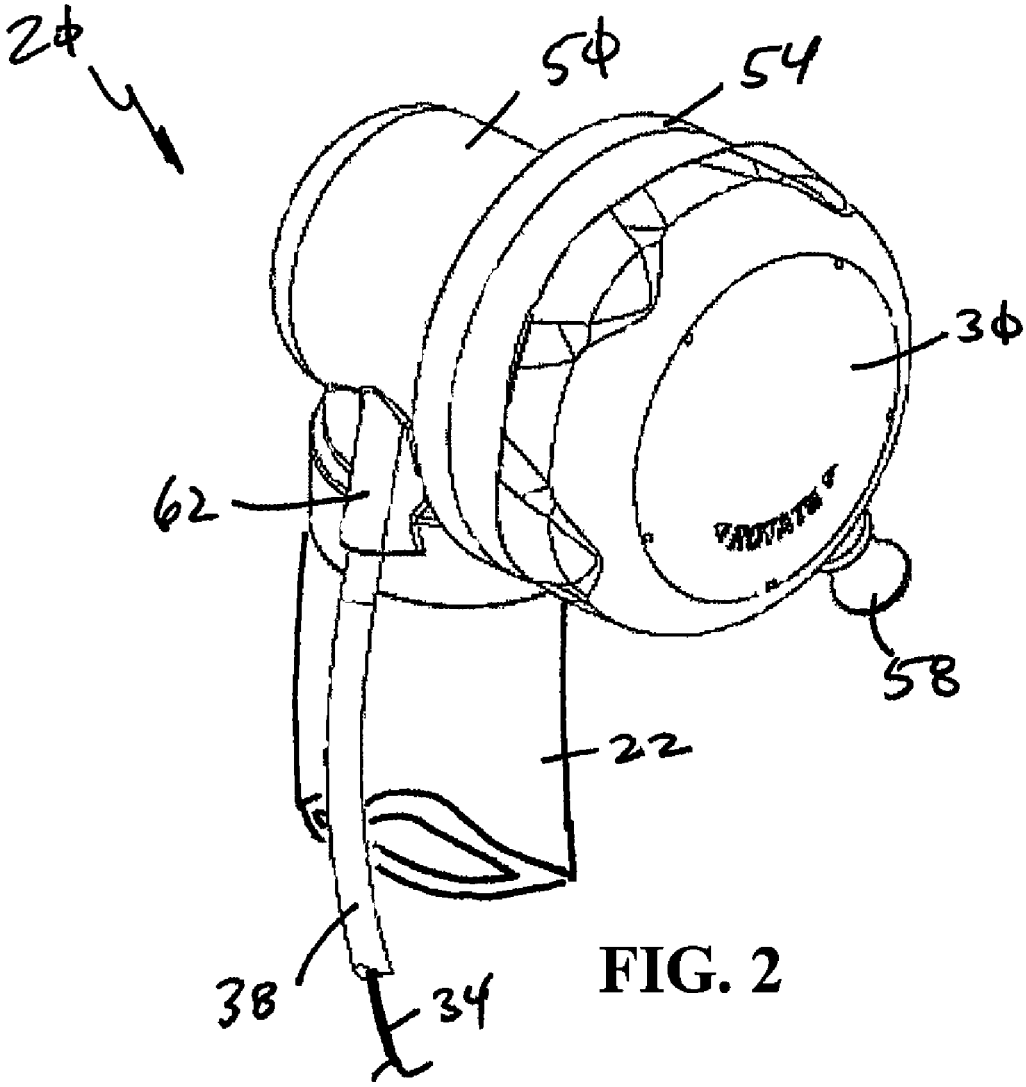
FIG. 2 is a partial perspective view of an overflow assembly of one embodiment of the present invention.
Figure 3:
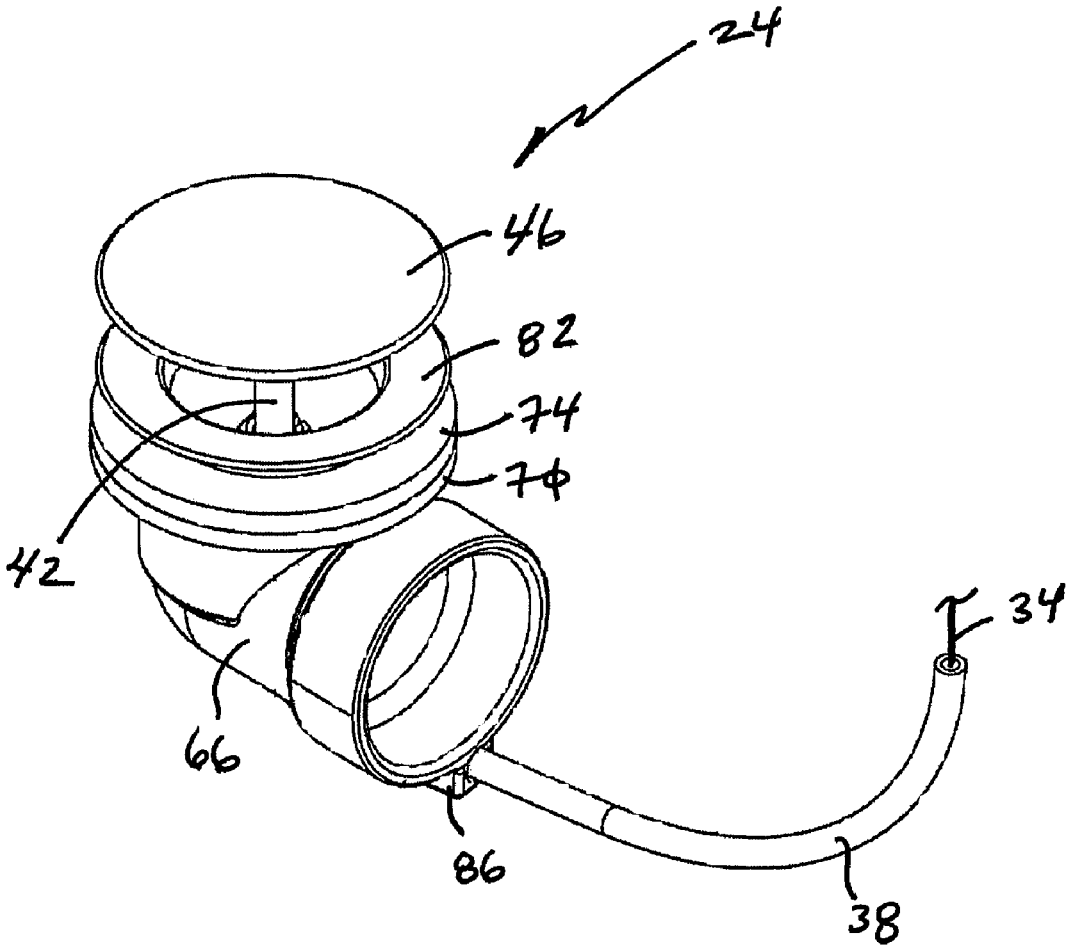
FIG. 3 is partial rear perspective view of a drain assembly of one embodiment of the present invention.

Referring now specifically to FIG. 2, the overflow assembly 20 is shown that is comprised of an overflow elbow 50 interconnected to the overflow pipe 22. The overflow elbow 50 also includes a flange 54 that is spaced from the overflow cap 30. The overflow cap 30 may also include a knob 58 positioned thereon that facilitates rotation of the cap 30 as well. The overflow elbow 50 also includes a boss 62 that is interconnected to the sheath 38 that slidingly houses the cable 34 therein.

Figure 4:
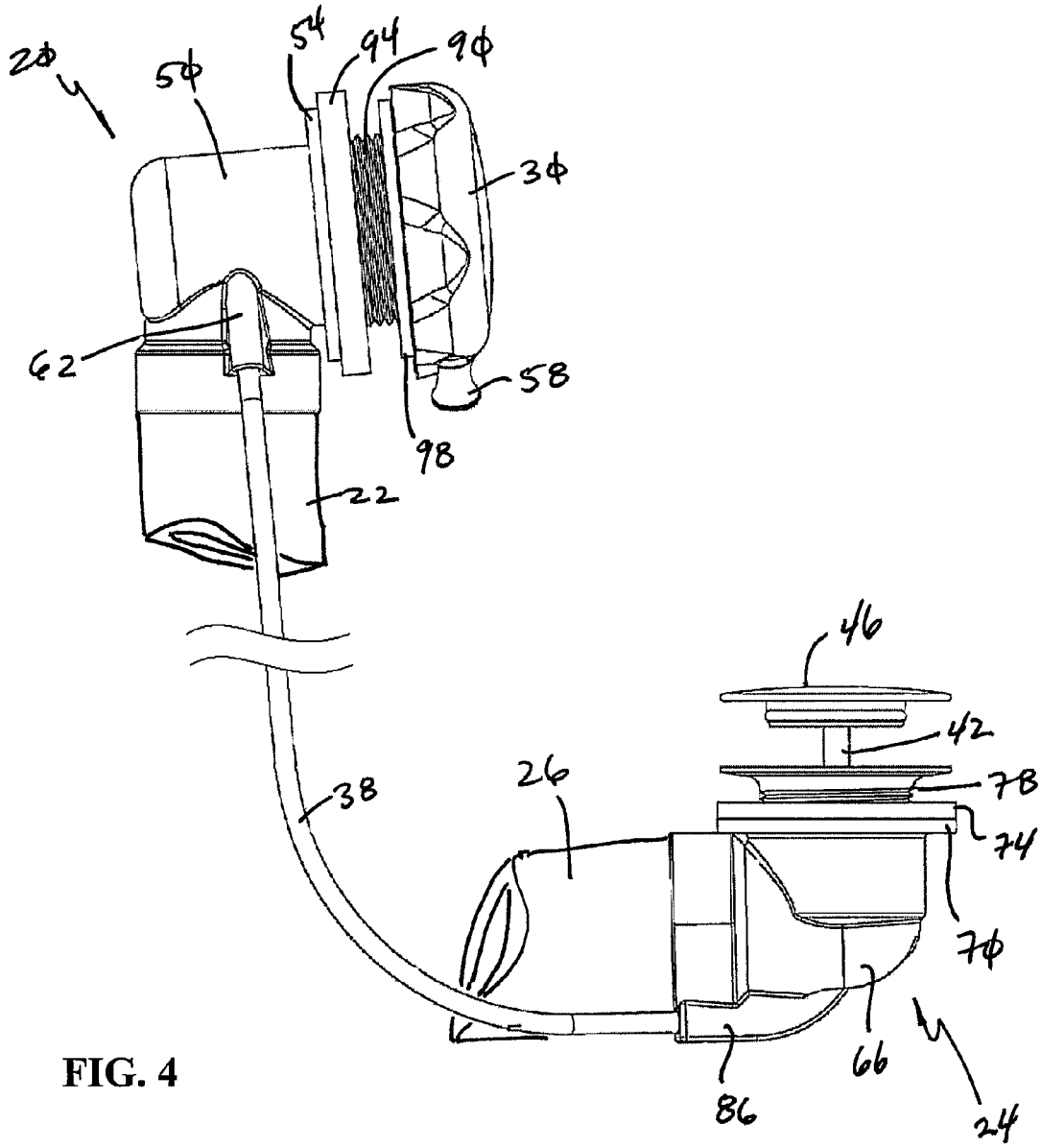
FIG. 4 is a partial front elevation view of the drain system of one embodiment of the present invention.
Figure 5:
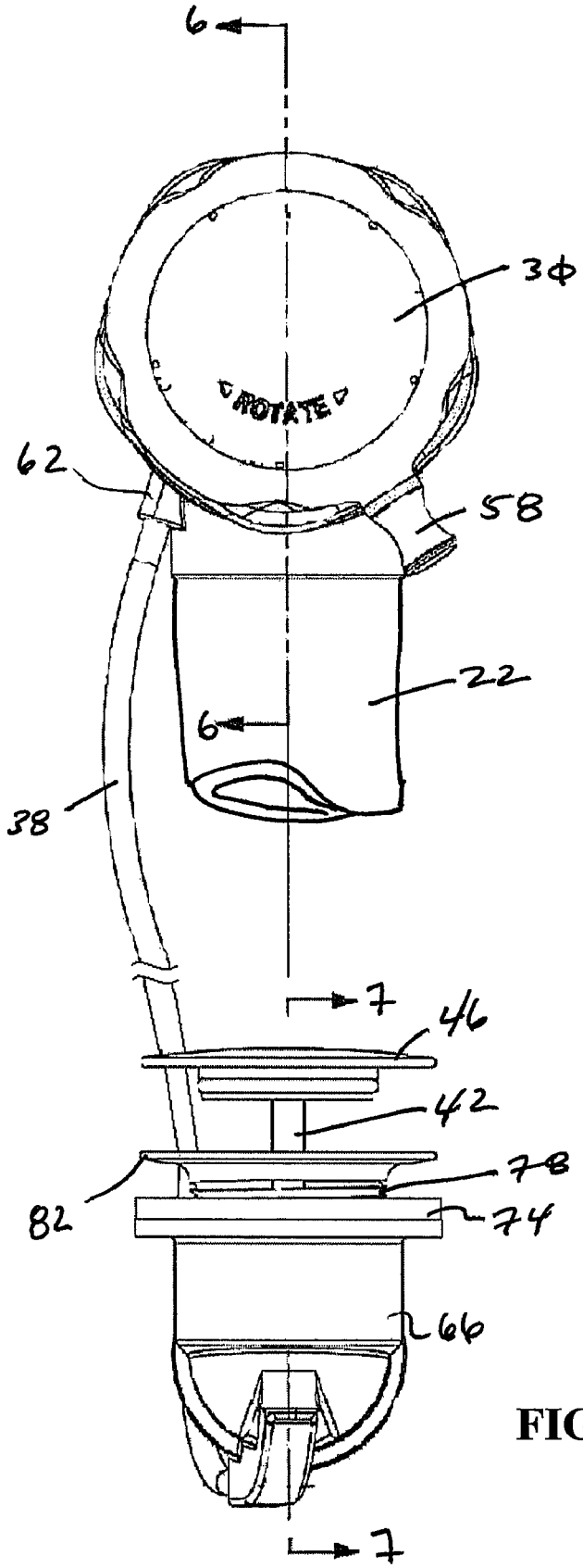
FIG. 5 is a right elevation view of FIG. 4.

Referring now to FIG. 4, the drain assembly 24 of one embodiments of the present invention is shown that includes a drain elbow 66 that is associated with a drain flange 70 on one end and a drain pipe on the other end (not shown). Embodiments of the present invention also include a seal 74 that is associated with the drain flange 70 and a strainer 78 that includes a strainer flange 82 that is spaced from the seal 74. In operation, the strainer flange 82 and seal 74 cooperate to tightly engage the drain port of the bathtub. The drain assembly 24 includes the post 42 that is associated with the drain elbow 66 that has a head 46 that selectively moves away from the strainer flange 82 to allow water through the drain elbow 66 or against the strainer flange 82 to prevent water drainage through the drain assembly 24. The drain assembly 24 also includes a boss 86 that receives the sheath 38 that holds the cable 34.

Referring now to FIGS. 4-7, the assembly of one embodiment of the present invention is shown. Here, the overflow assembly 20 is associated with the drain assembly 24 via the overflow pipe 22 and the drain pipe 26. That is, one skilled in the art will appreciate that the overflow pipe 22 meets the drain pipe 26 at a tee connection that is also interconnected to a primary drain of a dwelling, the tee and the primary drain are not shown for clarity. The overflow assembly 22 also includes a threaded member 90 and a seal 94. The threaded member 90 is adapted to be placed within the overflow port of the bathtub wherein a nut 98 is interconnected thereto and used in conjunction with the seal 94 and overflow flange 54 to firmly attach the overflow assembly 20 to the bathtub. The cap 34 is then rotatably interconnected to the nut 98 and associated with the cable 34 residing within the sheath 38. Again, as discussed above, the drain assembly 24 includes the flange 70 and associated seal 74 that cooperates with the flange 82 of a strainer 78 to firmly secure the drain assembly 24 to the bottom portion of a bathtub.

Figure 6:
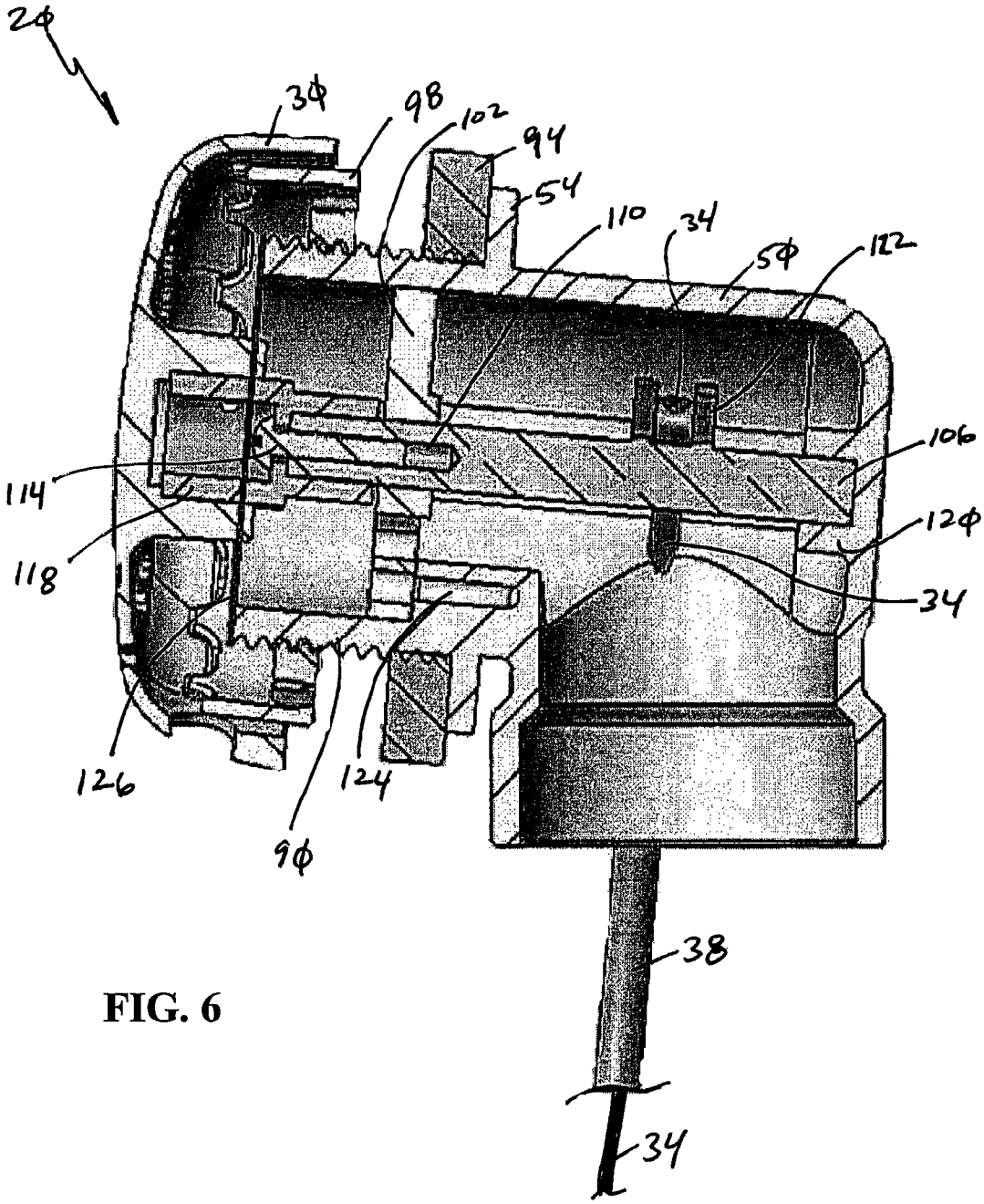
FIG. 6 is a cross-sectional view of the overflow assembly shown in FIG. 5.

Referring now specifically to FIG. 6, one embodiment of the present invention is shown. It is appreciated that the overflow assembly 20 also includes a plate 102 that is situated within the overflow elbow 50. The plate 102 rotatably receives a shaft 106 that has a tapped hole 110 on one end for receiving a screw 114 that receives a fitting 118 and secures the fitting 118 to the shaft 106. The fitting 118 may be provided in various lengths or a shim may be used in conjunction with the fitting 118 to create sufficient spacing that allow fluid flow. The shaft 106 is also rotatably interconnected to a hub 120. The fitting 118 is a swage fitted to the overflow cap 30, such that rotation of the cap 30 will rotate the shaft 106. The shaft 106 includes a linkage 122, i.e., clevis that is rotatably associated with the cable 34 such that the rotation of the shaft 106 will move one end of the cable 34 therearound which pulls the cable 34 relative to the sheath 38. The plate 102 may be secured to the inner portions of the overflow assembly via fasteners (not shown) that engage tapped holes 124 integrated into the overflow port. FIG. 6 also shows that the threaded portion 90 of the overflow elbow 50 may be capped with a thin diaphragm 126, which will be described in further detail below.

Figure 7:
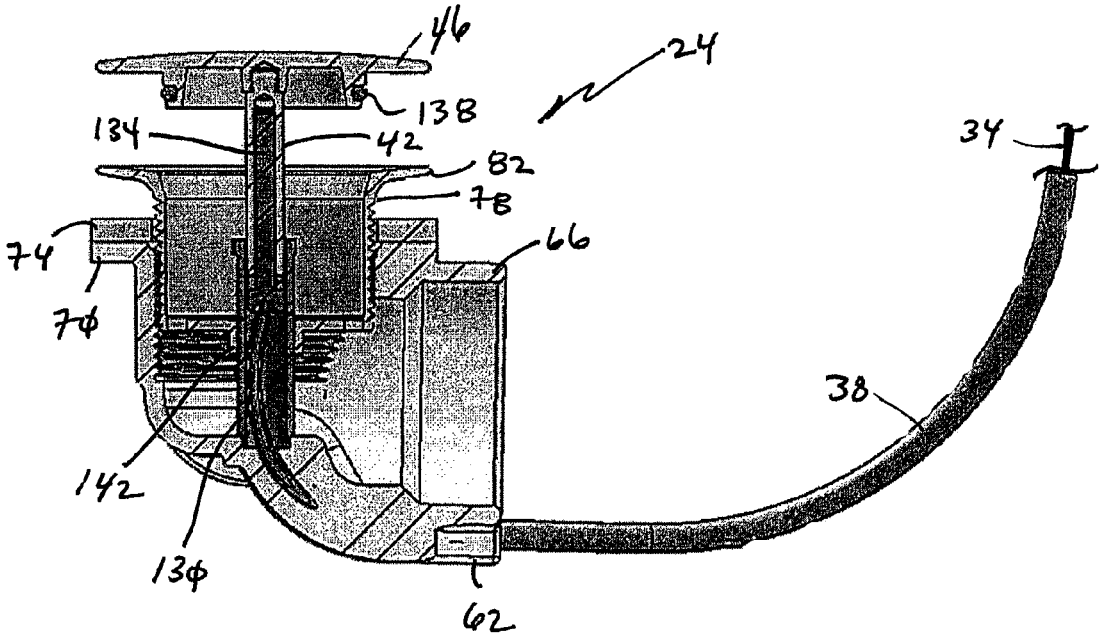
FIG. 7 is a cross-sectional view of the drain assembly shown in FIG. 6.

Referring now to FIG. 7, the drain assembly 24 of one embodiment of the present invention is shown. The drain assembly 24 includes a shaft 130 that is slidingly associated with the post 42 and preferably is hollow and provides a location of a bolt 134. The end of the cable 34 resides within the shaft 130 and contacts the end of the post 42 or the bolt 134 as shown. In operation, the bolt 134 may be used to selectively lengthen or shorten the length of the post 42 to allow for a minute adjustment of the closing operation of the cable 34. The head 46 of the drain assembly 24 may also include a sidewall 134 that receives a seal 138 to facilitate the blocking of the strainer 78. The shaft 130 is threadingly engaged, slidingly engaged or interference fit onto a hub 142 of the strainer 78.

Figure 8:
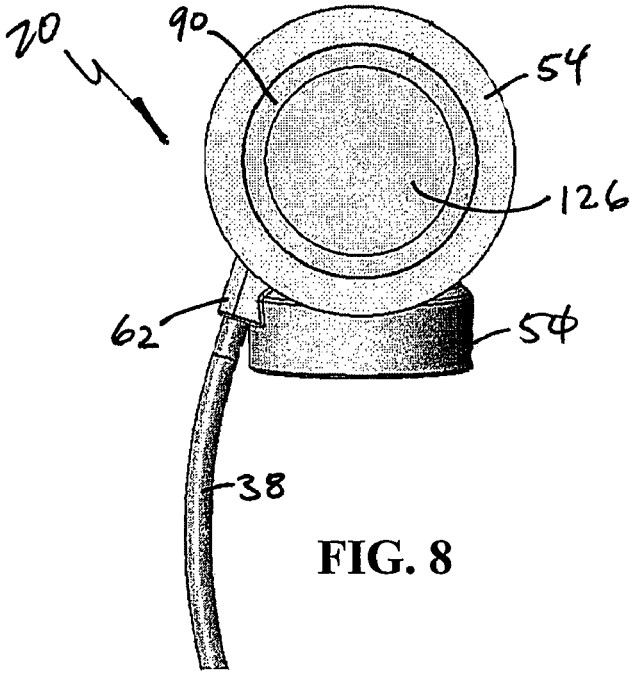
FIG. 8 is a front elevation view of an overflow assembly employing a diaphragm.
Figure 9:
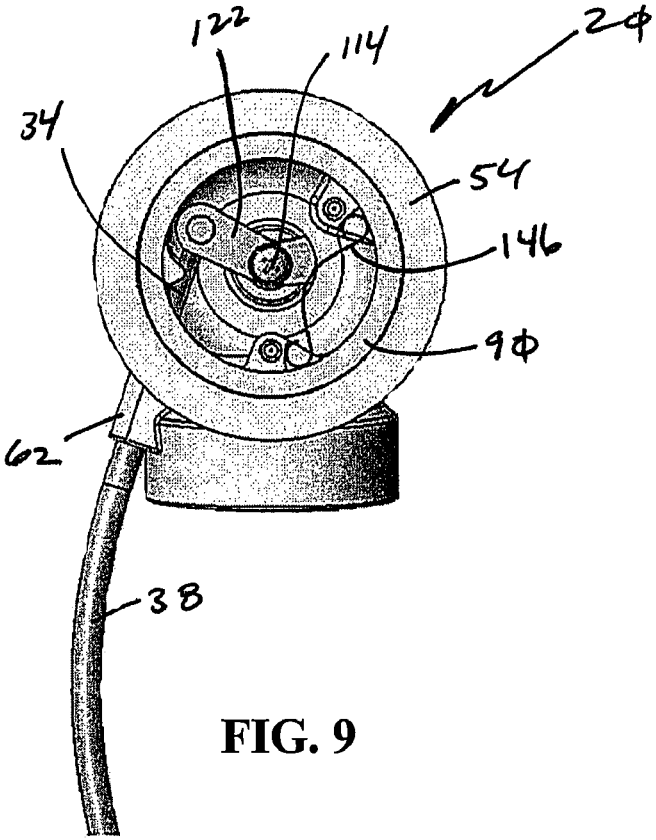
FIG. 9 is a front elevation view of an overflow assembly employing a diaphragm after removal thereof.

Referring now to FIGS. 8 and 9, one embodiment of the present invention is shown that allows for selective testing of the plumbing system is shown. Here, the overflow assembly 20 includes a thin diagram 126 associated with an end thereof, a threaded portion 90, for example. As such, fluids are prevented from passing through the overflow assembly 20. After testing is completed, that portion of the overflow assembly is removed to allow water through the overflow assembly 20.

FIG. 9 shows the linkage 122 that is associated with the shaft 106. The overflow assembly 20 may also include a spring 146, such as a leaf spring, that is associated with the inner portion of the overflow assembly 124. The spring 146 reacts loads from the linkage 122 if the device is turned too far and facilitates the return of the linkage 122 to its first position of use and thus the cable 34 to its first position of use, which aids in moving the head of the drain assembly. The spring of some embodiments of the present invention may be integrated, i.e. molded, directly into the plate 102. One of skill in the art will appreciate that the spring, or other biasing device, may not be required wherein the cable/sheath combination may possess sufficient frictional interaction to provide the contemplated recoil.

FIGS. 6 and 9 also illustrate to one skilled in the art in that the components of the system are readily accessible and easily replaced. That is, all of the components associated with moving the linkage 122 and the cable 34 may be replaced by removing the cover and/or diaphragm 126 of the overflow assembly. For example, the screw 114 may be removed to gain access to the plate 102 and the linkage 122 and associated shaft 106. The cable 34, which is rotatably associated with one end of the linkage 122, may also be removed from the sheath 38 and replaced. As shown in FIG. 7, the other end of the cable 34 would then be abutted against the bolt 134 of the drain assembly 24. Adjusting the location of the bolt 134 situated within the post 42 (i.e., by tightening or by loosening) will affect the interplay between the cable 34 and the head 46.

Figure 10:
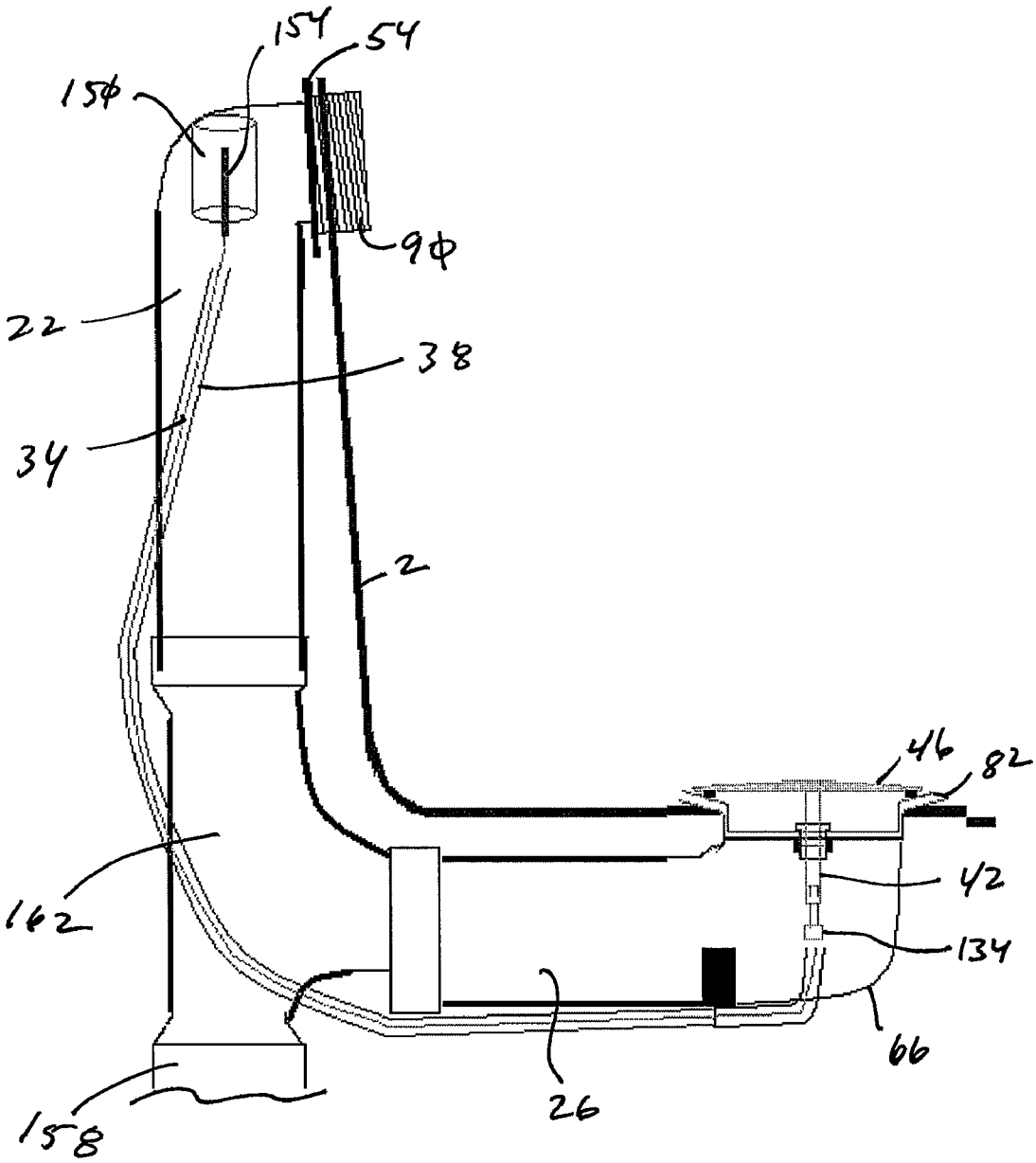
FIG. 10 is a front elevation view of an alternative embodiment of the present invention.

Referring now to FIG. 10, an alternative embodiment of the present invention is shown. Here, a solenoid motor 150 is employed that is associated with one end of the cable 34. In operation, one would depress a button or twist a knob, for example, to activate the solenoid 150 by creating a magnetic field that would pull magnetic portion 154 of the cable 34. By pulling or pushing such magnet 154, the cable 34 situated within the sheath 38 moves relative thereto to actuate the drain system of the plumbing system. One skilled in the art will appreciate that the solenoid motor can be placed anywhere within the plumbing system as long as access thereto is provided without an access panel.

The embodiments of the present invention disclosed herein may be incorporated with the inventions described in U.S. Pat. No. 5,745,931, entitled "Method and Means for Covering the Flange of a Waste Water Strainer", U.S. Pat. No. 5,758,368, entitled "Waste Water Valves For Bathtubs and the Like", U.S. Pat. No. 5,890,241, entitled "Method and Means for Installing Overflow Outlets to Bathtubs and the Like U.S. Pat. No. 6,066,119, entitled "Waste Water Strainer and Valve U.S. Pat. No. 6,138,298, entitled "Clip on Fluid Overflow Plate for Bathtubs U.S. Pat. No. 6,148,454, entitled "A Solenoid Control for a Bathtub Waste Water Drain U.S. Pat. No. 6,173,459, entitled "A Control For a Bathtub Waste Water Drain U.S. Pat. No. 6,226,806, entitled "Waste Water Strainer and the Like U.S. Pat. No. 6,317,906, entitled "Strainer Assembly for Bathtub Drains and the Like U.S. Pat. No. 6,418,570, entitled "Drain Closure U.S. Pat. No. 6,546,573, entitled "Drain Cover Assembly U.S. Pat. No. 6,631,623, entitled "Condensate Drain Attachments and Method of Use Thereof U.S. Pat. No. 6,637,050, entitled "Overflow Assembly for Bathtubs and the Like U.S. Pat. No. 6,640,358, entitled "Strainer Assembly for Bathtub Drains and the Like U.S. Pat. No. 6,675,406, entitled "Overflow Assembly for Bathtubs and the Like U.S. Pat. No. 6,675,407, entitled "Solenoid Activated Bathtub Drain Closure U.S. Pat. No. 6,681,420, entitled "Method and Apparatus for Installing a Bathtub Assembly U.S. Pat. No. 6,691,411, entitled "Method of Installing a Waste Water Drain Assembly for a Bathtub U.S. Pat. No. 7,127,752, entitled "Overflow Assembly for Bathtubs and The Like U.S. Pat. No. 7,451,502, entitled "Bath Drain Closure Assembly U.S. Pat. No. 7,503,083, entitled U.S. Pat. "Means for Covering the Flange of a Waste Water Strainer" 2004-0103474, entitled "Cap for Sealing a Bathtub Overflow Port for Testing Purposes 2004-0117907, entitled "Method and Apparatus for Assembling and Sealing Bathtub Overflow and Waste Water Ports 2007-0130689, entitled "Tub Box and Method of Using Same 2008-0047060, entitled "Control for a Bathtub Waste Water Drain 2007-0039098, entitled "Bath Drain Closure Assembly 2008-0196161, entitled U.S. CIP Pat. "Flexible Bathtub Waste Pipe Assembly for Bathtubs and the Like" 2008-0235866, entitled "U.S. CIP Pat. "Overflow Assembly for Bathtubs and the Like"

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. However, it is to be expressly understood that such modifications and alterations are within the scope and spirit of the present invention, as set forth in the following claims.

What is claimed is:

1. A system of controlling a drain valve, comprising:

an overflow pipe;

a plate associated with said overflow pipe, said plate having an aperture therethrough;

a shaft rotatably positioned within said aperture of said plate;

a;

a sheath associated with said overflow pipe and a drain pipe wherein a cable resides in an internal volume thereof and is able to slide freely therein;

wherein said cable has a first end associated with said shaft and a second end directly engaged to a post that is associated with a head portion of a drain valve; and; and wherein rotation of said shaft moves said second end of said cable from a first position to a second position, which opens the drain valve.

2. The system of claim 1, further comprising a cap rotatably associated with said overflow pipe and associated with said shaft.

3. The system of claim 2, wherein said cap further comprises a knob that facilitates rotation thereof.

4. The system of claim 1, wherein said drain pipe is associated with a strainer that possesses an inwardly disposed hub for receipt of a hollow shaft that slidingly receives said post.

5. The system of claim 1, wherein said shaft includes a clevis that operable receives said first end.

6. The system of claim 1, further comprising:

a bathtub having an overflow port and a drain port;

wherein said overflow pipe includes a threaded end with a flange spaced therefrom, said overflow pipe positioned outside the bathtub with said flange associated with an outer surface of said bathtub and wherein said threaded end is positioned within said overflow port with a portion thereof extending into said bathtub;

a nut engaged onto said threaded portion of said overflow pipe that cooperates with said flange to firmly secure said overflow pipe to said bathtub, said nut also receiving an overflow cap; and wherein said drain pipe includes a flange that is associated with said outer surface of said bathtub, said drain pipe also associated with a strainer body with an outwardly extending flange that cooperates with said flange of said drain pipe to firmly interconnect said drain pipe to said bathtub, said strainer also possessing an inwardly disposed hub for receipt of a hollow shaft that slidingly receives said post.

7. The system of claim 6, further comprising a diaphragm associated with the threaded end of said overflow pipe.

8. The system of claim 6, wherein said post is capable of moving from a closed position wherein said head is position proximate to said flange of said of said drain pipe to an open position wherein said head is position away from said flange of said of said drain pipe.

9. A system of controlling a drain valve, comprising:

an overflow pipe;

a drain pipe;

a sheath associated with said overflow pipe and said drain pipe; and a cable slidingly positioned within said sheath, said cable having a first end associated with said overflow pipe and a second end associated with said drain pipe and directly engaged to a drain valve, said first end being accessible by way of an opening in said overflow pipe and said second end being accessible by way of an opening in said drain pipe.

10. The system of claim 9, wherein said drain pipe is associated with a strainer that possesses an inwardly disposed hub for receipt of a hollow shaft that slidingly receives a post that is associated with a head of the drain valve, said post being directly engaged to said second end of said cable such that movement of said cable selectively moves said post.

11. The system of claim 9, further comprising a shaft located within said overflow pipe wherein rotation of said shaft moves said second end of said cable from a first position to a second position that opens a drain valve associated with said drain pipe.

12. The system of claim 11, further comprising a cap rotatably associated with said overflow pipe and associated with said shaft.

13. The system of claim 12, further comprising:

a bathtub having an overflow port and a drain port;

wherein said overflow pipe includes a first end with a flange spaced therefrom, said overflow pipe positioned outside the bathtub with said flange associated with an outer surface of said bathtub and wherein said first end extends into said bathtub;

a nut engaged onto said first portion of said overflow pipe that cooperates with said flange to firmly secure the overflow port to said bathtub, said nut also receiving said cap; and wherein said drain pipe includes a flange that is engaged onto said outer surface of said bathtub, said drain pipe also associated with a strainer body with an outwardly extending flange that cooperates with said flange of said drain pipe to firmly interconnect said drain pipe to said bathtub.

14. The system of claim 13, further comprising a diaphragm associated with the first end of said overflow pipe.

* * * * *

UNITED STATES PATENT AND TRADEMARK OFFICE

CERTIFICATE OF CORRECTION

PATENT NO. : 8,336,131 B2
APPLICATION NO. : 12/542205
DATED : December 25, 2012
INVENTOR(S) : William T. Ball, Eric Pilarczyk and Kevin Hogan It is certified that error appears in the above-identified patent and that said Letters Patent is hereby corrected as shown below:

In the Claims

In column 9, claim 1, line 15, delete "a"

In column 9, claim 1, line 21, replace "valve; and; and" with -- valve; and --

In column 9, claim 6, line 52, replace "said strainer" with -- said strainer body --

In column 10, claim 8, line 4, replace "said head is position" with -- said head portion is positioned --

In column 10, claim 8, line 5, replace "of said of said" with -- of said --

In column 10, claim 8, line 6, replace "said head is position" with -- said head portion is positioned --

In column 10, claim 8, line 7, replace "of said of said" with -- of said --

Signed and Sealed this
Twenty-eighth Day of May, 2013

Teresa Stanek Rea
*Acting Director of the United States Patent and Trademark Office*